US007540709B1

(12) United States Patent
Ebert

(10) Patent No.: US 7,540,709 B1
(45) Date of Patent: Jun. 2, 2009

(54) BOX RIM CAVITY FOR A GAS TURBINE ENGINE

(75) Inventor: Todd A. Ebert, West Palm Beach, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 452 days.

(21) Appl. No.: 11/255,125

(22) Filed: Oct. 20, 2005

(51) Int. Cl.
*F04D 29/08* (2006.01)

(52) U.S. Cl. ..... 415/173.7; 415/174.5

(58) Field of Classification Search ..... 415/173.1, 415/173.5, 173.6, 173.7, 174.5, 199.5
See application file for complete search history.

(56) References Cited

U.S. PATENT DOCUMENTS 2,333,053 A * 10/1943 Stroehlen ..... 415/175
2,687,279 A * 8/1954 Ljungberg ..... 416/174
3,262,635 A 7/1966 Smuland
3,623,736 A 11/1971 Petrie et al.
3,824,030 A 7/1974 DeFeo
3,841,792 A 10/1974 Amos
3,897,169 A 7/1975 Fowler
4,830,575 A 5/1989 Bandukwalla
5,224,822 A 7/1993 Lenahan et al.
5,232,339 A * 8/1993 Plemmons et al. ..... 415/178
5,236,302 A * 8/1993 Weisgerber et al. ..... 415/173.7
5,320,488 A * 6/1994 Meade et al. ..... 415/173.7
5,338,154 A * 8/1994 Meade et al. ..... 415/173.7
5,429,478 A 7/1995 Krizan et al.
5,503,528 A 4/1996 Glezer et al.
6,068,443 A 5/2000 Aoki et al.
6,155,574 A * 12/2000 Borgstrom et al. ..... 277/419
6,428,270 B1 8/2002 Leone et al.
6,506,016 B1 * 1/2003 Wang ..... 415/173.7
6,517,314 B1 2/2003 Burnett et al.
6,524,065 B2 2/2003 Briesenick et al.
6,669,443 B2 12/2003 Burnett et al.
6,773,229 B1 8/2004 Itzel et al.
6,851,931 B1 * 2/2005 Tomberg ..... 416/189

* cited by examiner

*Primary Examiner*—Edward Look
*Assistant Examiner*—Aaron R Eastman
(74) *Attorney, Agent, or Firm*—John Ryznic

(57) ABSTRACT

A gas turbine engine having a rotor with blades and a stationary vane, a platform seal is formed between the blade and vane for inhibiting ingestion of hot gas from a hot gas flow through the turbine into turbine wheel spaces, the platform seal including axial extending platforms on the blade and vane, and radial extending fingers extending from the platforms and forming restrictions between the fingers and the platforms, and a buffer cavity formed between the restrictions, where the fingers are so arranged in a generally radial direction that the vane can be removed from the turbine engine in a radial direction without having to remove the blades first. In additional embodiments, the platform seal assembly can have two or three buffer cavities formed between additional restrictions.

5 Claims, 2 Drawing Sheets

BOX RIM CAVITY FOR A GAS TURBINE ENGINE

BACKGROUND OF THE INVENTION

1. Field of the Invention

The present invention relates to a gas turbine engine, and especially to a seal arrangement formed on platforms of the rotary blades and the stationary vanes.

2. Description of the Related Art Including Information Disclosed Under 37 CFR 1.97 and 1.98

Rim seals are axial extensions of a turbine rotor blade, i.e., a bucket, which form a seal by overlapping with vane (nozzle) seal lands forming part of the fixed component of a gas turbine. The rim seal inhibits ingestion of hot gas from the flow path into gas turbine wheel spaces. Typically, rim seals are cast integrally as part of the blade or bucket, or are multiple overlays having multiple angel wings. Conventional airfoil platform seals have such a shape that the vane cannot be removed from the turbine without also removing the rotor blade because of the overlapping of adjacent platforms, i.e. the platform extending from the vane overlaps with the platform extending from the blade. Multiple overlap rim seals are assembled axially, and therefore the vanes cannot be removed radially from the casing due to interference with platforms on the blades that form the rim seal. U.S. Pat. No. 5,236,302 issued to Weisgerber et al on Aug. 17, 1993 shows a turbine disc interstage seal system in which an air seal is formed between adjacent platforms of the blade and the vane, where a finger of the vane platform extends in-between a space formed between two fingers extending from the blade platform. The vane in the Weisgerber invention cannot be removed from the turbine without removing the blade, since the fingers on the platforms interfere with each other.

Gas turbine engines also produce circumferential static pressure variations downstream from the airfoils. In a typical gas turbine, the gas stream flows past the airfoils both rotating and stationary, and the static pressure exiting the airfoil passage varies between two extreme pressures. This variation in static pressure acts across the rim seal at the platforms, and will cause undesirable hot gas ingestion into the wheel space without the presence of a rim seal. Multiple overlaps create a desirable buffer cavity or volume to dissipate this circumferential pressure variation.

It is an object of the present invention to provide for a platform design that will provide an airflow seal between adjacent blade and vane platforms and also allow for the vane to be removed from the turbine without removing the blade.

It is a further object of the present invention to provide for a platform seal that will attenuate the flow path asymmetry in the gas stream, or in other words to reduce the leakage across the platform seal due to the static pressure vibration acting on the platform seal.

It is a further object of the present invention to allow for removal of a vane in a radial direction instead of the axial direction, the vane having a platform seal arrangement with at least two overlaps forming the seal.

SUMMARY OF THE INVENTION

The present invention is an airflow seal between adjacent platforms of a rotary blade and a stationary vane or nozzle in a gas turbine engine, where the platform seal includes fingers extending in a radial direction of the turbine. The air seal of the present invention is formed from a platform extending from the blade and a platform extending from the vane. The vane platform is located above the blade platform, and fingers extend from one platform to the other platform to form an air gap. The two platforms form a cavity between the two air gaps. The cavity and the restrictions formed by the gaps act to attenuate the flow path asymmetry or static pressure vibrations acting on the platform seal and reduce leakage across the seal. Because the platform on the vane is located above the platform on the blade, and since the finger on the vane extends radially inward, the vane can be removed from the turbine in a radial direction without having to remove the blade due to interference of the blade platform with the vane platform.

DETAILED DESCRIPTION OF THE INVENTION

Figure 1:
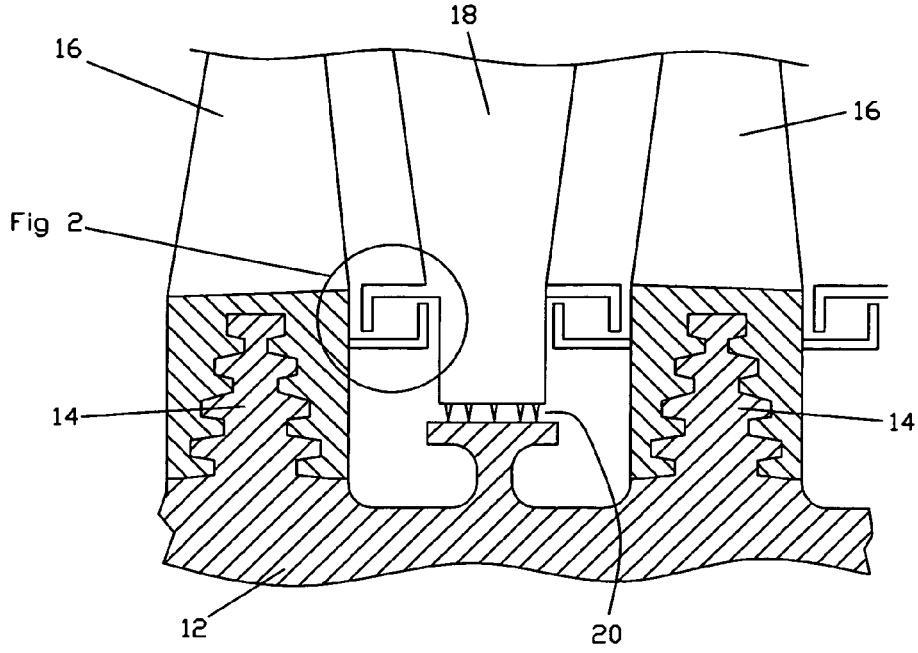
FIG. 1 shows a cross sectional view of a gas turbine engine with the platform air seal of the present invention.

The present invention can be seen from FIG. 1 in which a gas turbine engine includes a rotor shaft 12 having rotor discs extending radially outward and having fir tree portions 14, rotary blades 16 mounted on the fir tree portions extending from the rotor disc 12, and a stationary vane or nozzle 18 extending from a turbine casing toward the rotor shaft 12. The stationary vane includes a labyrinth seal 20 formed between the vane tip and a member extending from the rotor shaft to form an interface of the labyrinth seal.

Figure 2:
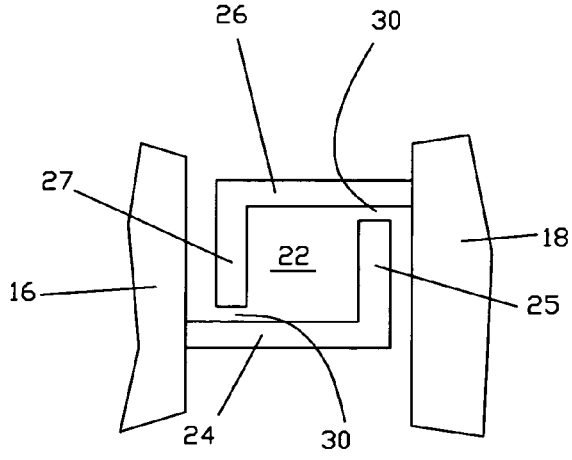
FIG. 2 shows a detailed view of the platform seal of the present invention, with the fingers extending from the platform to form the cavity and air gaps.

The platform seal of the present invention is shown in detail in FIG. 2, where a blade platform 24 extends from the blade 16, and a vane platform 26 extends from the vane 18. The blade platform 24 includes a blade finger 25 extending from the end of the blade platform 24, and the vane platform 26 includes a vane finger 27 extending from the vane platform 26. A buffer cavity 22 is formed between the platforms and the fingers. An upstream gap or restriction 30 is formed between the blade platform 24 and the vane finger 27, and a downstream gap or restriction 30 is formed between the vane platform 26 and the blade finger 25. The gaps 30 form a restriction for the air flow into and out of the buffer cavity 22. The fingers 25 and 27 are so arranged that the vane 18 can be removed from the turbine without having the remove the blade 16. In FIG. 1, the vane would be removed by lifting the vane in an upward direction as shown in FIG. 1. the blade platform 24 and the vane platform 26 both extend generally in an axial direction, and the blade finger 25 and the vane finger 27 extend generally in a radial direction in order to allow the vane to be removed in a radial direction without having to remove the blade first. The generally axial and radial directions can be offset from the axial axis and radial axis as long as the platforms and fingers do not interfere with a radial removal of the vane.

The purpose for the buffer cavity 22 and the restrictions 30 are to attenuate the vibrations in the static pressure acting across the platform seal. The cavity size and the restriction gaps are sized depending upon the static pressure vibration levels. The cavity acts to dampen the static pressure vibrations.

Figure 3:
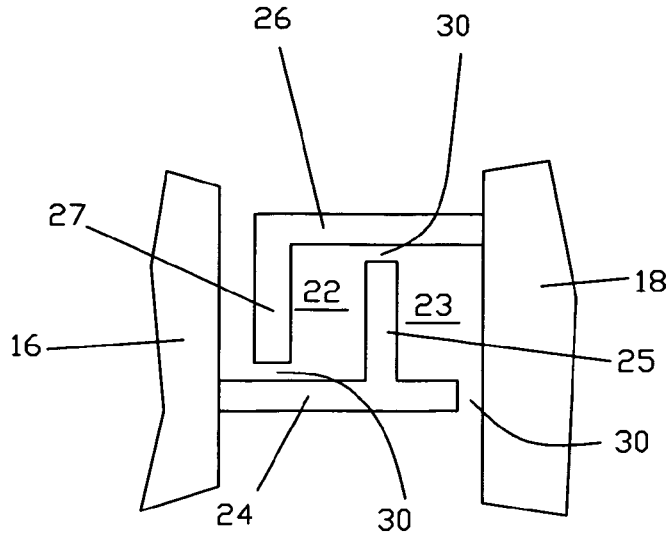
FIG. 3 shows a detailed view of a second embodiment of the platform seal structure.

A second embodiment of the present invention is shown in FIG. 3, in which the platform seal is formed of two buffer cavities and three restrictions. The blade platform 24 includes the blade finger 25 and restriction 30 shown in the first embodiment, and adds a second finger that forms a third restriction 30. A second buffer cavity 23 is also formed between the second restriction 30 and the third restriction 30. The second buffer cavity 23 acts to further attenuate the static pressure vibrations that the first buffer cavity 22 attenuates in part. The seal arrangement of FIG. 3 will also allow for the removal of the vane from the turbine without the need to remove the blade. Therefore, the vane assembly can be serviced without the need to remove the blades.

Figure 4:
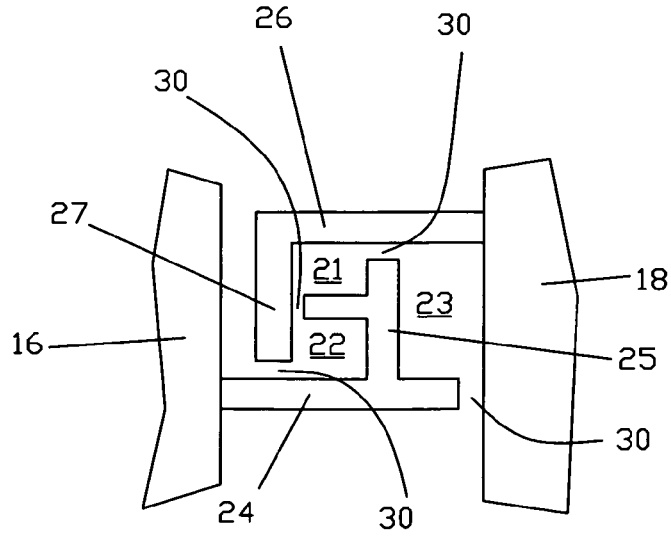
FIG. 4 shows a detailed view of a third embodiment of the platform seal structure.

A third embodiment of the present invention is shown in FIG. 4. This embodiment adds an additional restriction 30 to form four restrictions 30 and three buffer cavities 21, 22, and 23 in series to attenuate the static pressure vibrations across the platform seal.

I claim the following:

1. In a gas turbine engine having a rotor rotatable mounted about an axis, a blade carried by said rotor for rotation therewith and nozzles, a seal between each rotor blade and nozzle for inhibiting ingestion of hot gas from a hot gas flow through the turbine engine into a turbine wheel space, comprising:

a blade platform extending generally in an axial direction from a blade root;

a blade finger extending generally in a radial direction from the blade platform;

a vane platform extending generally in an axial direction from a vane root;

a vane finger extending generally in a radial direction from the vane platform;

a first restriction formed between the blade platform and the vane finger;

a second restriction formed between the first restriction and the second restriction; and, the blade platform extends beyond the blade finger and forms a third restriction and a second buffer cavity.

2. The gas turbine engine of claim 1 above, and further comprising:

a second blade finger extending from the first blade finger and forming a fourth restriction between the second blade finger and the vane finger and forming a third buffer cavity.

3. A turbine in a gas turbine engine comprising:

a rotor blade rotatable secured to a rotor disk in the turbine;

a stator vane extending from a casing of the turbine;

a buffer cavity formed between the rotor blade and the stator vane to limit egress of a hot gas flow passing through the turbine;

the buffer cavity being formed by a vane platform with a vane finger extending from the stator vane, and a blade platform and a blade finger extending form the rotor blade;

the platforms and the fingers being of such structure to allow for the stator vane to be removed from the turbine in a radial direction instead of an axial direction;

the vane platform is located in a radial outward direction from the blade platform;

the vane finger and the blade finger both include ends that form a restriction with the apposed platform which defines the buffer cavity; and, the blade platform includes an end that forms a second restriction for the buffer cavity, where the first blade finger extends from the blade platform toward the vane platform to define two buffer cavities.

4. The turbine of claim 3, and further comprising:

a second blade finger extends from the first blade finger toward the first vane finger to form a third restriction with the vane finger, the first blade finger and the second blade finger forming three buffer cavities.

5. The turbine of claim 3, and further comprising:

the blade and vane platforms extend in an axial direction and the blade and vane fingers extend in a radial direction.

* * * * *